US005361833A

United States Patent [19]

Schock et al.

[11] Patent Number: 5,361,833

[45] Date of Patent: Nov. 8, 1994

[54] BOTTOM SET, NON-RETRIEVABLE WHIPSTOCK ASSEMBLY

[75] Inventors: William H. Schock; Shannon P. Rogers, both of Lafayette, La.

[73] Assignee: Triumph*LOR, Inc., Houston, Tex.

[21] Appl. No.: 154,814

[22] Filed: Nov. 18, 1993

[51] Int. Cl.[5] ..... E21B 7/08

[52] U.S. Cl. ..... 166/117.6; 166/138

[58] Field of Search ..... 166/117.5, 117.6, 382; 175/61, 73, 81, 82

[56] References Cited

U.S. PATENT DOCUMENTS

| | | | |
|---|---|---|---|
| Re. 20,398 | 6/1937 | Keever | 255/1 |
| 1,502,428 | 7/1924 | Getty . | |
| 1,634,582 | 7/1927 | Kinzbach . | |
| 1,804,819 | 5/1931 | Spencer, Jr. et al. . | |
| 1,806,509 | 5/1931 | Straatman . | |
| 1,970,761 | 8/1934 | McVicar | 255/1 |
| 2,065,896 | 12/1936 | Keever | 255/1 |
| 2,102,055 | 12/1937 | Brauer | 255/1 |
| 2,105,721 | 1/1938 | Cutrer et al. | 255/1 |
| 2,105,722 | 1/1938 | Barrett et al. | 255/1 |
| 2,107,420 | 2/1938 | Kothny | 255/1 |
| 2,119,746 | 6/1938 | Lane | 255/1 |
| 2,132,061 | 10/1938 | Walker | 255/1 |
| 2,147,585 | 2/1939 | Trotter | 255/1 |
| 2,170,284 | 8/1939 | Eastman | 255/1 |
| 2,171,020 | 8/1939 | Ackley | 255/1 |
| 2,196,517 | 4/1940 | Bolton | 255/1 |
| 2,196,528 | 4/1940 | Hughes | 255/1 |
| 2,196,944 | 4/1940 | Sharp | 255/1 |
| 2,207,920 | 7/1940 | Hughes | 255/1 |
| 2,216,963 | 10/1940 | Sinclair | 255/1 |
| 2,252,620 | 8/1941 | DeLong | 255/1 |
| 2,258,001 | 10/1941 | Chamberlain | 255/1 |
| 2,285,024 | 6/1942 | Ferguson | 255/1.4 |
| 2,296,161 | 9/1942 | Hall, Jr. . | |
| 2,312,805 | 3/1943 | Douglas | 255/1.4 |
| 2,331,293 | 10/1943 | Ballard | 255/1.6 |
| 2,334,746 | 11/1943 | Brantly | 255/1.6 |
| 2,357,330 | 9/1944 | Hyer | 255/1.6 |
| 2,362,529 | 11/1944 | Barrett et al. | 255/1.6 |
| 2,368,413 | 1/1945 | Creighton | 255/1.6 |
| 2,386,514 | 10/1945 | Stokes | 175/81 |
| 2,401,893 | 6/1946 | Williams, Jr. | 255/1.4 |
| 2,438,293 | 3/1948 | Livingston | 255/1.6 |
| 2,445,100 | 7/1948 | Wright | 255/1.6 |
| 2,495,439 | 1/1950 | Brimble | 255/1.4 |
| 2,498,159 | 2/1950 | Gammill | 255/1.6 |

(List continued on next page.)

OTHER PUBLICATIONS

P. 17 of Triumph-LOR brochure re: Whipstock.
P. 16 of Triumph-LOR brochure re: Milling Tools.
Homco A-1 Bit & Tool brochure, pp. 9-11, 25-26.
Lindsey Completion Systems, Inc. General Catalog 1992-1993 (cover page, pp. 8, 9, 27).
A-Z Grant International General Catalog 1992-1993 (cover page, p. 15).
Pp. 55 and 59 of Eastman Christensen brochure re: Special Products & Services.
A-Z Grant International brochure (pp. 8, 9, 27).
Eastman Christensen General Catalog 1992-1993 (cover page, pp. 55, 56, 59, listing of locations).
Frank's 1992-1993 General Catalog (cover page, p. 14, listing of locations).

*Primary Examiner*—Michael Powell
*Assistant Examiner*—Frank S. Tsay
*Attorney, Agent, or Firm*—Pravel, Hewitt, Kimball & Krieger

[57] ABSTRACT

A whipstock assembly includes a whipstock and a non-retrievable setting tool. The non-retrievable setting tool includes a terminal body which is adapted to engage a bottom obstruction. The terminal body mounts a plurality of wedge members for movement radially outwardly as the wedge members are moved downwardly by an internally mounted piston member. The piston member is moved downwardly by an actuating cylinder which is attached to the whipstock. A spring member is positioned between the actuating cylinder and the piston to provide more uniform engagement between the actuating cylinder and the piston as the actuating cylinder and piston move downwardly thus moving the wedge members radially outwardly into engagement with the casing.

6 Claims, 3 Drawing Sheets

U.S. PATENT DOCUMENTS

| | | | |
|---|---|---|---|
| 2,498,192 | 2/1950 | Wright | 255/1.6 |
| 2,506,799 | 5/1950 | Livingston | 255/1.6 |
| 2,544,982 | 3/1951 | Buttolph | 255/1.6 |
| 2,553,874 | 5/1951 | Spaulding et al. | 255/1.6 |
| 2,586,662 | 2/1952 | Jackson | 255/1.6 |
| 2,586,878 | 2/1952 | Staton | 255/1.6 |
| 2,632,630 | 3/1953 | Storm | 255/1.6 |
| 2,634,097 | 4/1953 | Zublin | 255/1.6 |
| 2,642,267 | 6/1953 | Zublin | 255/1.6 |
| 2,667,332 | 1/1954 | McCune et al. | 255/1.6 |
| 2,669,428 | 2/1954 | Zublin | 255/1.6 |
| 2,669,429 | 2/1954 | Zublin | 255/1.6 |
| 2,669,430 | 2/1954 | Zublin | 255/1.6 |
| 2,691,507 | 10/1954 | Brown | 255/1.6 |
| 2,694,549 | 11/1954 | James | 255/1.6 |
| 2,699,920 | 1/1955 | Zublin | 255/1.6 |
| 2,709,070 | 5/1955 | Bielsten | 255/1.6 |
| 2,712,436 | 7/1955 | McCune et al. | 255/28 |
| 2,716,539 | 8/1955 | Pickard | 255/1.6 |
| 2,716,540 | 8/1955 | McCune et al. | 255/1.6 |
| 2,716,542 | 8/1955 | Goble | 255/28 |
| 2,726,847 | 12/1955 | McCune et al. | 255/1.6 |
| 2,766,010 | 10/1956 | Hester | 255/1.6 |
| 2,770,444 | 11/1956 | Neal | 255/1.6 |
| 2,778,603 | 1/1957 | McCune et al. | 255/1.6 |
| 2,779,570 | 1/1957 | Roper | 255/1.6 |
| 2,797,893 | 7/1957 | McCune et al. | 255/1.6 |
| 2,797,894 | 7/1957 | Meyer | 255/1.6 |
| 2,821,362 | 1/1958 | Hatcher | 255/1.6 |
| 2,823,012 | 2/1958 | Hanna | 255/1.6 |
| 2,839,270 | 6/1958 | McCune et al. | 255/1.6 |
| 2,858,107 | 10/1958 | Colmerauer | 255/1.6 |
| 2,906,499 | 9/1959 | Travis | 255/1.6 |
| 2,921,630 | 1/1960 | Le Bus, Sr. | 266/103 |
| 2,965,182 | 12/1960 | Galeener | 175/82 |
| 3,011,568 | 12/1961 | Grimm | 175/74 |
| 3,029,874 | 4/1962 | Turman | 166/212 |
| 3,075,583 | 1/1963 | Nielsen et al. | 166/117.5 |
| 3,116,799 | 1/1964 | Lemons | 175/61 |
| 3,194,327 | 7/1965 | Smithson | 175/61 |
| 3,215,204 | 11/1965 | Sims | 166/117.5 |
| 3,330,349 | 7/1967 | Owsley et al. | 166/21 |
| 3,353,607 | 11/1967 | Kinley | 166/117.5 |
| 3,477,524 | 11/1969 | Marks, Jr. | 175/82 |
| 3,908,759 | 9/1975 | Cagle et al. | 166/117.6 |
| 4,007,797 | 2/1977 | Jeter | 175/26 |
| 4,303,134 | 12/1981 | Dismukes | 175/61 |
| 4,305,462 | 12/1981 | Eilers et al. | 166/117.6 |
| 4,397,360 | 8/1983 | Schmidt | 175/61 |
| 4,420,049 | 12/1983 | Holbert | 175/45 |
| 4,427,062 | 1/1984 | Tower | 166/113 |
| 4,429,741 | 2/1984 | Hyland | 166/63 |
| 4,431,053 | 2/1984 | Morrow | 166/117.5 |
| 4,527,639 | 7/1985 | Dickinson, III et al. | 175/61 |
| 4,693,327 | 9/1987 | Dickinson et al. | 175/61 |
| 4,733,732 | 3/1988 | Lynch | 175/9 |
| 4,763,734 | 8/1988 | Dickinson et al. | 175/61 |
| 4,807,704 | 2/1989 | Hsu et al. | 166/313 |
| 4,852,666 | 8/1989 | Brunet et al. | 175/61 |
| 4,928,767 | 5/1990 | Jelsma | 166/377 |
| 5,012,877 | 5/1991 | Winters et al. | 175/80 |
| 5,029,653 | 7/1991 | Jürgens et al. | 175/61 |
| 5,035,292 | 7/1991 | Bailey et al. | 175/45 |
| 5,052,502 | 10/1991 | Jurgens et al. | 175/80 |
| 5,109,924 | 5/1992 | Jurgens et al. | 166/117.5 |
| 5,113,938 | 5/1992 | Clayton | 166/117.6 |
| 5,115,872 | 5/1992 | Brunet et al. | 175/61 |
| 5,148,877 | 9/1992 | MacGregor | 175/79 |
| 5,154,231 | 10/1992 | Bailey et al. | 166/298 |
| 5,193,620 | 3/1993 | Braddick | 166/382 |

BOTTOM SET, NON-RETRIEVABLE WHIPSTOCK ASSEMBLY

FIELD OF THE INVENTION

The field of this invention relates to whipstock assemblies for deviating the direction of drilling in a cased borehole, and in particular is directed to non-retrievable whipstock assemblies.

BACKGROUND OF THE INVENTION

Whipstocks are well known in the oil well drilling art and have been utilized for many decades. A whipstock is an elongated tool having a long, tapered, concave surface. The whipstock is set downhole in an oil well such that the concave surface thereof provides a guide to a milling tool to mill out an opening in the oil well casing to provide a new, angled direction for additional drilling. While whipstocks have been known for these many years, their present use is increasing due to the cost of drilling, making it desirable to drill as many wells as possible off of a central, cased borehole.

In order to utilize a whipstock, it is necessary to anchor the whipstock against the casing in the borehole. One type of anchoring mechanism is retrievable such that, after use, the whipstock and the anchoring mechanism can be retrieved from the borehole. Another type of anchoring mechanism for a whipstock is non-retrievable. Non-retrievable or single trip whipstock anchor assemblies are well known in the art. For example, U.S. Pat. No. 5,154,231 discloses a hydraulically set anchoring assembly for a whipstock wherein a series of wedges are cammed outwardly into an anchoring position against a borehole in response to pressurized fluid. In the '231 patent, there is a mechanical interlock in the form of ratchet surfaces to prevent the wedges from releasing once set. U.S. Pat. No. 4,429,741 discloses a downhole tool anchor that is set by explosive power. The explosive operates to cam outwardly a series of wedges or slips into an anchoring position against the casing thereby setting the anchoring tool and thus the connected whipstock for operation. A ratchet surface or locking pawl is machined on an inner mandrel to engage the actuating cones which move outwardly the wedges or slips in order to lock them into position.

U.S. Pat. No. 3,029,874 also discloses an anchoring device which is actuated by fluid pressure. Again, the anchoring device utilizes slips or wedges which are cammed into outer engagement against the casing. In the '874 patent, fluid pressure actuates a piston which is moved downwardly in between the wedges to expand the wedges into engagement against the casing.

U.S. Pat. No. 2,172,055 discloses another type of mechanical anchoring mechanism utilizing a central mandrel to cam outwardly a plurality of slips into engagement against the interior wall of the casing.

In spite of these various mechanisms, there remains a need for a highly reliable, mechanical setting anchor that can be set by downward movement of the drilling string and thereafter remain in an anchored position to support a whipstock for deviating to a new drilling path.

SUMMARY OF THE INVENTION

This invention is directed to a whipstock assembly attachable to a drill string for changing the direction of drilling from a vertical direction within a cased borehole to a direction angled from the longitudinal axis of the existing, cased borehole. The assembly includes a whipstock including an elongated body having a tapered, concave portion adapted to receive and direct milling apparatus in a direction angled from the longitudinal axis of the cased borehole. A non-retrievable setting tool is attached to the whipstock for setting the whipstock in the cased borehole. The non-retrievable setting tool includes a terminal body adapted to engage the bottom of the borehole or other obstruction when the whipstock and non-retrievable setting tool are run into the borehole. The terminal body has a central internal bore and a plurality of wedge actuating recesses circumferentially spaced on the outside of the body. A wedge member or slip is mounted in each wedge actuating recess for slidable movement outwardly into engagement with the cased borehole. A piston member is mounted within the terminal body bore for engaging the wedge members and moving the wedge members slidably outwardly within the terminal body wedge actuating recesses. An actuating cylinder member is mounted within said terminal body bore and has a connector portion extending into connection with the whipstock and an actuating cylinder section positioned in engagement with the piston for moving the piston into engagement with the wedge members for moving the wedge members radially outwardly into engagement with the casing of the borehole.

This description is intended as a summary only and is not intended to define the limits of the invention.

DESCRIPTION OF THE PREFERRED EMBODIMENT

Figure 1:
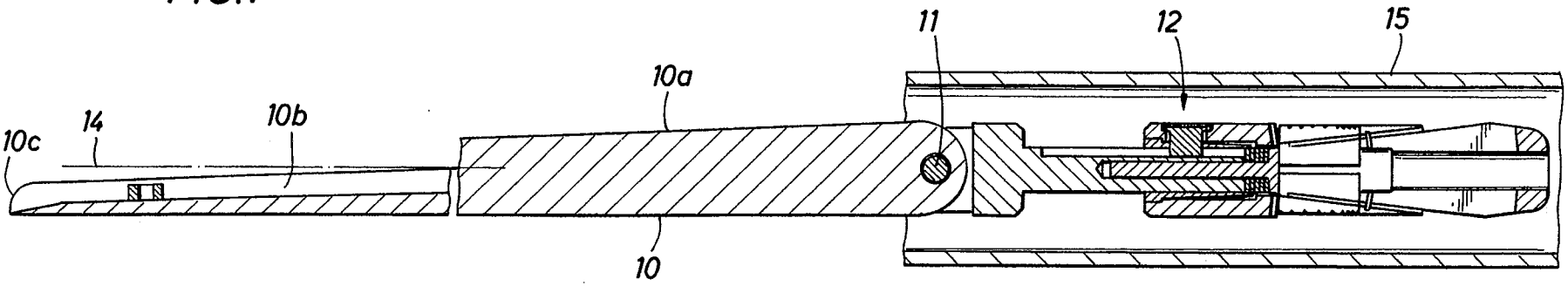
FIG. 1 is a side view of the whipstock assembly of the preferred embodiment of this invention.

Referring to the drawings and in particular to FIG. 1, a whipstock generally designated as 10 is attached by pin 11 to a non-retrievable setting tool generally designated as 12. The whipstock 10 is well known in the art and is basically a one-piece, elongated member **10*a* having an internal, concave surface 10*b* which tapers outwardly from its upper (left-hand side) tip 10*c* to near its pivotal connection at pin 11 to the non-retrievable setting tool 12. As previously described, the purpose of the whipstock 10 is well known in the art. The whipstock is run down the cased borehole defined by casing 15 in an oil well, gas well or other borehole and, after being set in position, serves as a guide to a drilling tool such as a rotating mill to deviate the drilling direction from the axis 14 of the casing 15. As the milling tool moves downwardly from the tip 10***c* of the whipstock, the tapered surface 10*b* guides the milling tool gradually, outwardly so that the milling tool cuts a window through the casing 15 to initiate a new drilling direction.

The non-retrievable setting tool 12 is provided to expand into engagement against the inside wall of the casing 15 and to anchor against the wall so that the whipstock 10 remains stationary during the milling operation. After the milling operation, the whipstock is maintained in position permanently.

A generally cylindrical terminal body or housing 16 includes a cylindrical bore 16*a* which extends from the surface 16*d* of the body 16 to the upper end 16*c*. The bore may continue throughout the length of the body to the lower end 16*b*.

Figure 2:
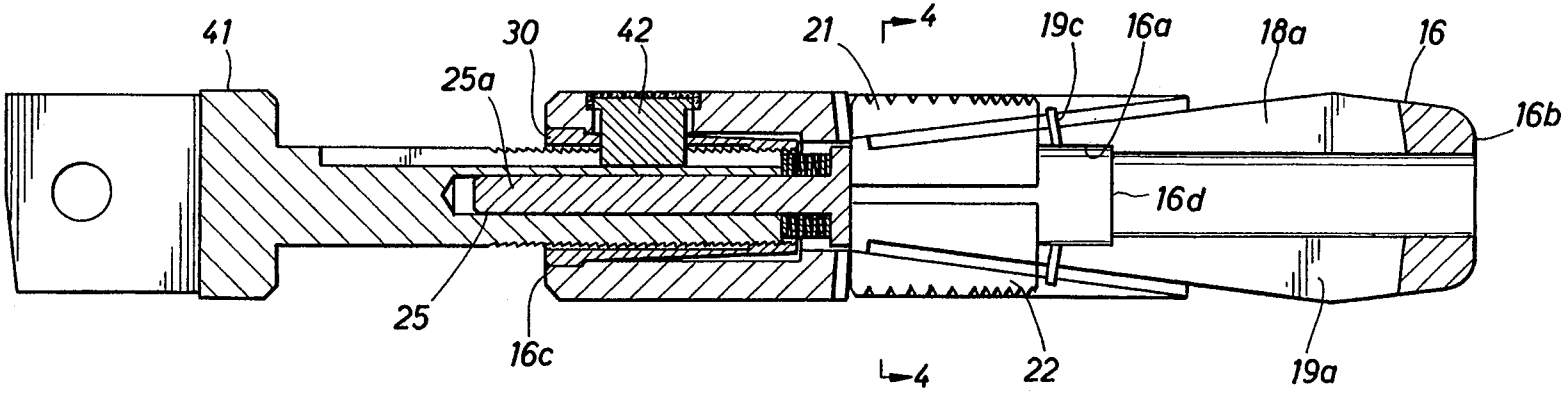
FIG. 2 is a sectional view taken along line 2—2 of FIG. 4 illustrating the wedge elements of the non-retrievable setting tool in a withdrawn, non-actuated position.
Figure 5:
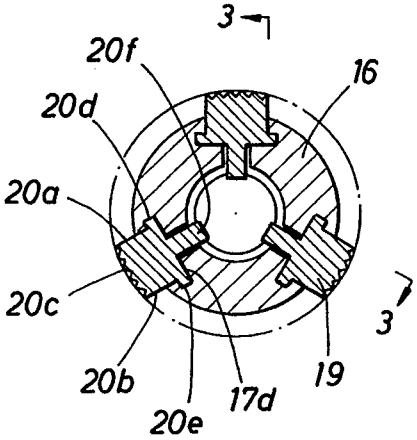
FIG. 5 is a sectional view taken along line 5—5 of FIG. 3.
Figure 4:
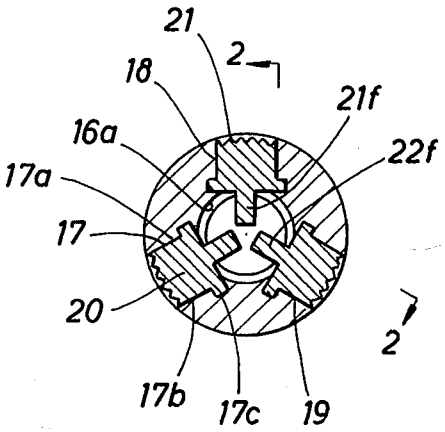
FIG. 4 is a sectional view taken along line 4—4 of FIG. 2.
Figure 7:
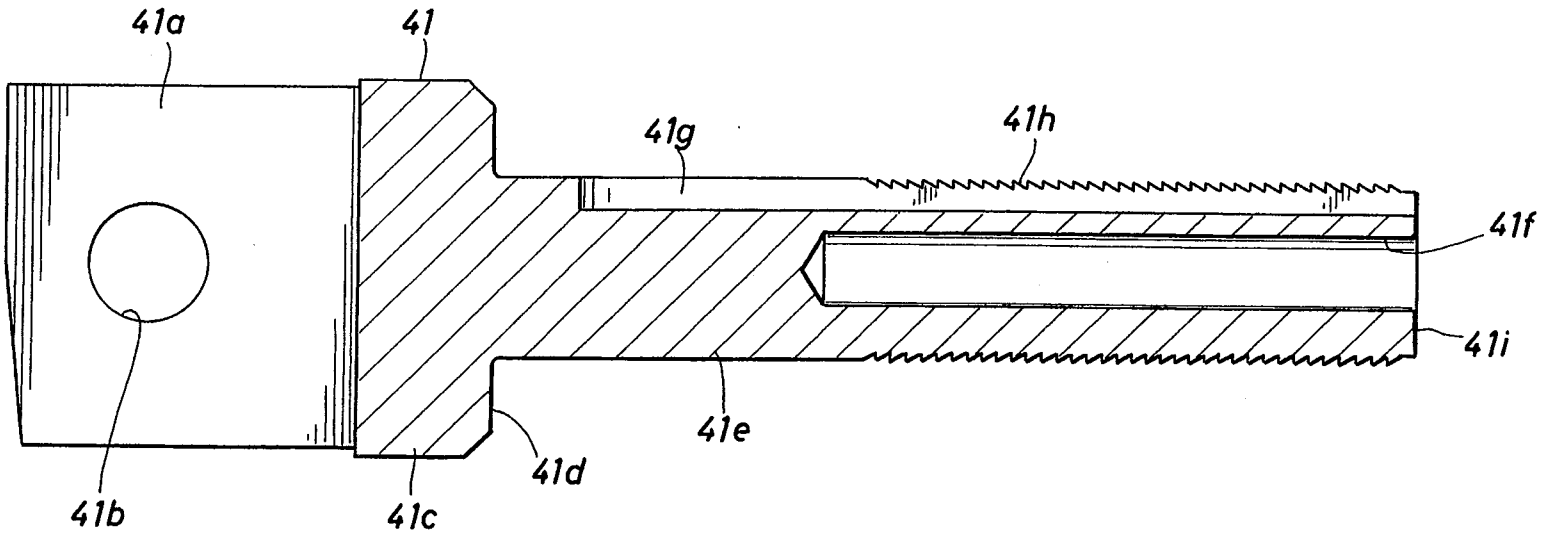
FIG. 7 is a side view partly in section illustrating the structure of the actuating cylinder.

Referring to FIGS. 4 and 5, the cylindrical body 16 includes three, circumferentially spaced T-shaped recesses 17, 18 and 19. The recess 17 includes generally radially directed side walls 17*a* and 17*b* which terminate in a widened set of opposing grooves 17*c*. Referring to FIGS. 4 and 5, the bottom surface 17*d* of the opposing grooves 17*c* is illustrated as being tapered outwardly as the groove slopes radially outwardly toward the bottom end 16*b* of the body 16. Referring to FIGS. 2 and 4, body side wall 18*a* for recess 18 and body side wall 19*a* for recess 19 is illustrated. The recesses 18 and 19 are structurally identical except for location with the recess 17 and need not be described further.

A plurality of wedges or slips 20, 21 and 22 are mounted in the recesses 17–19, respectively, so that the wedges are circumferentially spaced about the body 16. As illustrated in FIGS. 4 and 5, each wedge element such as wedge element 20 includes a T-shaped portion including side faces 20*a* and 20*b* and outside, serrated face 20*c*. The side faces 20*a* and 20*b* terminate in first and second side shoulder or tongue portions 20*d* and 20*e* which ride in the opposing grooves 17*c*. Each wedge element such as 20 further includes an internal, centrally mounted tang or protrusion portion 20*f*. The tang portion, such as 20*f*, for wedge element 20, extends radially into the central bore 16*a* both when the wedge elements are in the withdrawn position of FIG. 4 and when the wedge elements are in the expanded position of FIG. 5. The wedge members 21 and 22 are identical in structure to the wedge member 20 such that three tang portions 20*f*, 21*f* and 22*f* extend into the bore 16*a* of the terminal body 16. The wedge members are initially held in position by shear pins 19*c*.

A piston member or plunger 25 is mounted within the bore hole 16*a* for engagement against the tang portions 20*f*, 21*f*, and 22*f* of the wedge members for moving the wedge members radially outwardly as the piston member moves the wedge members downwardly towards the bottom end 16*b* of the body 16. The piston 25 includes a generally cylindrical section 25*a* having a diameter less than the diameter of the bore hole 16*a*. The piston member terminates in an enlarged head portion 25*b*, thus providing a circular, flat surface having a diameter substantially the same size as the internal bore 16*a* for engaging the tang portions 20*f*, 21*f* and 22*f* of the wedge members.

Figure 3:
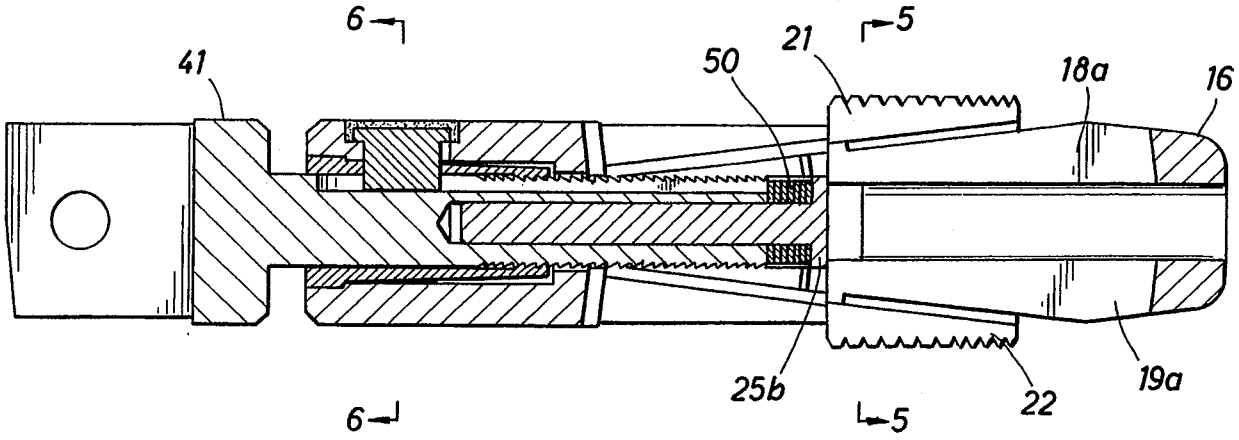
FIG. 3 is a sectional view taken along line 3—3 of FIG. 5 illustrating the wedge elements in an extended, actuated position for anchoring the setting tool.
Figure 6:
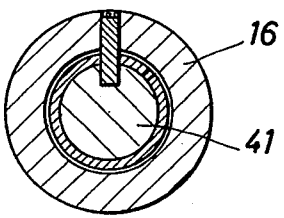
FIG. 6 is a sectional view taken along line 6≠6 of FIG. 3.
Figure 8:
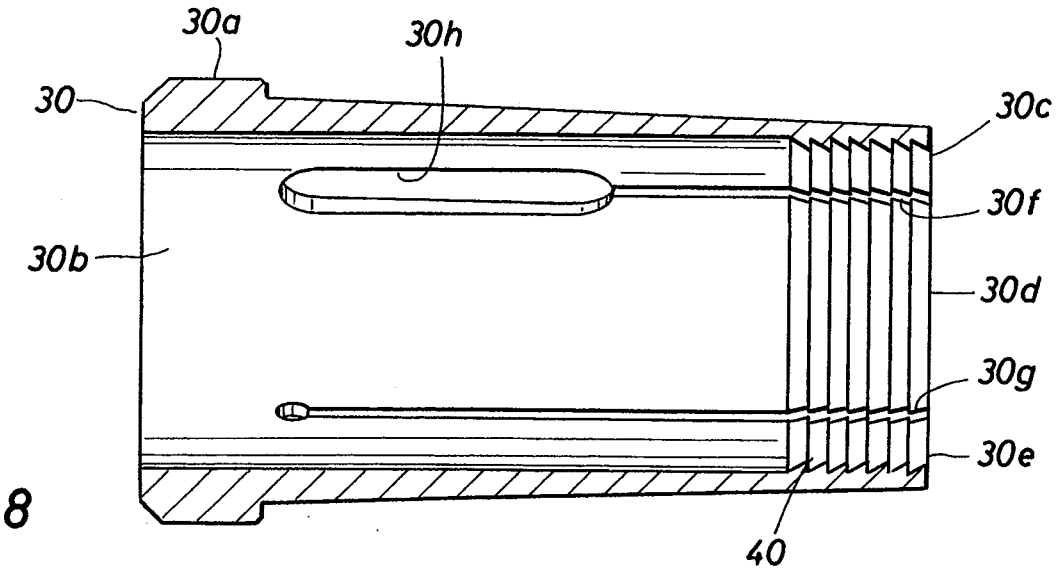
FIG. 8 is a side view partly in section of the second, stationary mounting cylinder which is positioned on the outside of the actuating cylinder of FIG. 7.

A stationary mounting cylindrical member or grapple 30 is shown in FIGS. 2, 3 and 8. The stationary cylinder 30 includes an upper shoulder section 30*a* for seating into an annular groove at the top 16*c* of the body 16, where the member 30 is welded to the body. The stationary cylinder 30 has an internal bore 30*b* which extends the length of the member. The lower portion of the stationary cylinder 30 is divided into a plurality of finger members 30*c*, 30*d*, 30*e* and others (not shown), by longitudinally extending, machined slots such as 30*f* and 30*g*. The slot 30*f* terminates in a wider, elongated opening 30*h*. The bottom portion of the stationary cylinder 30 includes a plurality of serrations or ratchet grooves 40 thus providing an annular serrated area.

An actuating cylinder or latch connector generally designated as 41 is shown in FIGS. 2–7. The actuating cylinder 41 includes an upper connector portion 41*a* which is a generally flat portion having an opening 41*b* therein to receive the pin 11 which connects the actuating member 41 to the whipstock 10. The flat connector section 41*a* joins a circular head portion 41*c* which is reduced by radial shoulder 41*d* into an elongated cylindrical actuator section 41*e*. The elongated cylindrical actuator section 41*e* includes an opening or bore 41*f* which rides over the cylindrical portion 25*a* of the piston 25. The actuator portion 41*e* of the actuating cylinder 41 includes an elongated keyway or slot 41*g*. A key 42 is mounted in a side opening in the body 16 and is inserted through the opening 30*h* in the stationary cylinder 30 into the keyway 41*g* thereby maintaining the actuating cylinder 41 against rotational movement with respect to the body 16. The lower portion 41*h* of the actuator portion 41*e* includes a plurality of external serrations, teeth or grooves complimentary to the serrations 40 in the interior bore of the stationary cylinder 30. In this manner, as the actuator cylinder 41 is moved downwardly by a running tool and running string connected to the whipstock, the serrations 41*h* and 40 engage each other and lock the actuating cylinder in place as it moves downwardly.

Beveled dish spring members (Belleville springs) 50 are positioned in the annular area formed between the circular surface of the piston section 25*a* and the wall of the body bore 16*a* such that the springs provide for a more uniform application of downwardly directed force by the annular end 41*i* of the actuating cylinder as it engages the shoulder of the piston head 25*b*.

In operation, a running tool attached to the end of a running or drill string is attached to the upper end of the whipstock 10 and moves the whipstock assembly including anchoring tool 12 down the cased borehole until the bottom end 16*b* of the tool body 16 hits an obstruction, which may be the bottom of the well, a cement plug, a packer or other obstruction. Such obstruction may be particularly placed by the drilling rig operator at the location at which a deviated hole is to begin. When the terminal body hits the obstruction and is held against further downward movement, continued downward movement of the running tool and the whipstock pushes the actuating cylinder 41 downwardly, which causes the lower, annular end 41*i* of the actuating cylinder to engage the springs 50 and press the springs against the upper shoulder of the piston head 25*b*. As the piston is thereby moved downwardly, the lower, circular face of the piston engages the tangs 20*f*, 21*f* and 22*f* of the wedge members 20, 21 and 22 and moves the wedge members downwardly. As the wedge members 20–22 move downwardly, the wedge members ride along the outwardly tapering surfaces of the wedge member recesses 17–19 until the wedge members are anchored against the casing 15. Pressure is maintained against the wedge members 20–22 by the compressed beveled dish spring members 50. At that point, due to the interlocking of the serrated portions 41*h* on the actuating cylinder 41 and 40 on the stationary cylinder 30, the wedge members 20–22 are locked in a radially outward and engaged position against the casing 15. Since the setting tool 12 is non-retrievable, the setting tool remains permanently in that position and holds the connected whipstock in position to initiate a deviated hole in a known manner.

Having described the invention above, various modifications of the techniques, procedures, material and equipment will be apparent to those in the art. It is intended that all such variations within the scope and spirit of the appended claims be embraced thereby.

We claim:

1. A whipstock assembly attachable to a drill string for changing the direction of drilling from a vertical direction within a cased borehole to a direction angled from the longitudinal axis of the cased borehole, comprising:

a whipstock including an elongated body having a concave portion adapted to receive and direct milling apparatus in a direction angled from the longitudinal axis of the cased borehole;

a non-retrievable setting tool attached to said whipstock for setting said whipstock in the borehole, the non-retrievable setting tool including the following:

a terminal body adapted to engage the bottom of the borehole or other obstruction when the whipstock and non-retrievable setting tool are run into the borehole, said terminal body having a central internal bore and a plurality of wedge actuating surfaces circumferentially spaced on the outside of said body;

a plurality of wedge members, each wedge member mounted on a wedge actuating surface for sliding movement outwardly into anchoring engagement with the cased borehole;

a piston member mounted within said terminal body bore for engaging said wedge members and moving said wedge members slidably outwardly along said terminal body wedge actuating surfaces;

an actuating cylinder member mounted within said terminal body bore, said actuating cylinder having a connector portion extending outwardly of said terminal body bore for connection to said whipstock; and, said actuating cylinder further including a cylindrical section mounted at least partially within said terminal body bore in operative engagement with said piston for moving said piston into engagement with said wedge members for moving said wedge members outwardly into engagement with the cased borehole.

2. The whipstock assembly of claim 1, including:

said cylindrical section including a central bore for receiving a portion of said piston member.

3. The whipstock assembly of claim 2, including:

spring means mounted between said cylindrical section of said actuating cylinder and said piston for maintaining engagement of actuating cylinder with said piston.

4. The whipstock assembly of claim 2, including:

position locking means formed on said actuating cylinder and mounted with said bore for locking the position of said actuating cylinder as said cylinder moves said piston and said wedges outwardly; and spring means mounted between said cylindrical section of said actuating cylinder and said piston for maintaining engagement of actuating cylinder with said piston.

5. The whipstock assembly of claim 4, including:

said position locking means including a second cylindrical member mounted within said bore of said terminal body, said second cylindrical member having an internal cylindrical surface which is serrated; and said cylindrical section of said actuating cylinder being serrated to engaged said serrated surface of said second cylindrical member in order to lock the position of said cylinder as said cylinder moves said piston and said piston moves said wedges outwardly.

6. The whipstock assembly of claim 5, including:

said cylindrical section of said actuating cylinder having a keyway;

said terminal body having a recess, and a key mounted in said recess and extending into said keyway to hold said cylindrical actuating member against rotational movement.

* * * * *